US005083779A

United States Patent [19]

Ungermann

[11] Patent Number: 5,083,779

[45] Date of Patent: Jan. 28, 1992

[54] UNIVERSAL GOLF CLUB CONSTRUCTION

[76] Inventor: Brett A. Ungermann, 3051 Teal Ridge Ct., San Jose, Calif. 95136

[21] Appl. No.: 682,995

[22] Filed: Apr. 10, 1991

[51] Int. Cl.[5] ..... A63B 53/06

[52] U.S. Cl. ..... 273/79; 273/81.2; 273/171; 273/80 D; 273/168

[58] Field of Search ..... 273/79, 168, 171, 80.1, 273/80.2, 81.2, 81.3, 80 D, 77 R

[56] References Cited

U.S. PATENT DOCUMENTS

| | | | |
|---|---|---|---|
| 1,535,707 | 4/1925 | Barnes | 273/79 |
| 1,697,846 | 1/1929 | Anderson | 273/79 |
| 1,697,998 | 1/1929 | Novak et al. | 273/79 |
| 2,002,108 | 5/1935 | Child | 273/171 X |
| 2,107,983 | 2/1938 | Hamilton | 273/81.2 |
| 2,477,438 | 7/1949 | Brouwer | 273/79 |
| 2,962,286 | 11/1960 | Brouwer | 273/168 X |
| 3,601,399 | 8/1971 | Agens | 273/79 |
| 3,840,231 | 10/1974 | Moore | 273/171 X |
| 3,893,670 | 7/1975 | Franchi | 273/79 X |
| 3,931,969 | 1/1976 | Townhill | 273/79 |
| 4,043,563 | 8/1977 | Churchward | 273/171 |
| 4,778,180 | 10/1988 | Guenther | 273/79 |

FOREIGN PATENT DOCUMENTS

| | | | |
|---|---|---|---|
| 3529253 | 1/1986 | Fed. Rep. of Germany | 273/171 |
| 1048806 | 8/1953 | France | 273/79 |
| 499734 | 11/1954 | Italy | 273/79 |
| 23839 | of 1915 | United Kingdom | 273/79 |
| 569266 | 5/1945 | United Kingdom | 273/79 |
| 600549 | 4/1948 | United Kingdom | 273/79 |

*Primary Examiner*—Edward M. Coven
*Assistant Examiner*—Sebastiano Passaniti
*Attorney, Agent, or Firm*—Henderson & Sturm

[57] ABSTRACT

A universal golf club construction (10) having a variable weight, pitch, and lie club head unit (13) mounted on a shaft unit (12) equipped with an adjustable length handle unit (11). The golf club head unit (13) is rotatably disposed relative to the shaft unit (12) to change the pitch of the club head unit (13) and the impact face member (34) is rotatably disposed relative to the remainder of the club head unit (13) to vary the lie of the impact face member.

9 Claims, 2 Drawing Sheets

UNIVERSAL GOLF CLUB CONSTRUCTION

TECHNICAL FIELD

The present invention relates to the field of golf club constructions in general, and in particular to an all-in-one golf club construction wherein the length, pitch, lie and weight of the golf club and impact face may be varied to produce different golf club configurations.

BACKGROUND ART

This invention was the subject matter of Document Disclosure Program Registration No. 237,554 which was filed in the United States Patent and Trademark Office on Oct. 23, 1989.

As can be seen by reference to the following U.S. Pat. Nos. 3,601,399; 3,893,670; 3,931,969; and 4,778,180; the prior art is replete with myriad and diverse adjustable golf club head constructions designed to produce different impact surface orientations relative to the club shaft.

While all of the aforementioned prior art constructions are more than adequate for the basic purpose and function for which they have been specifically designed, these patented constructions have been uniformly deficient with respect to the variability of not only the pitch and length of the golf club shaft and head, but also the lie and weight of the club head relative to the golf club shaft.

While most of the prior art constructions are concerned with the pitch of the golf club head and while at least the Townhill reference (U.S. Pat. No. 3,931,969) is concerned with both pitch and length, none of the known references deal with all four critical parameters.

As a consequence of the foregoing situation, there has existed a longstanding need among golfers for a universal golf club construction which allows the user to vary the length, weight, lie, and pitch of the golf club, and the provision of such a construction is a stated objective of the present invention.

DISCLOSURE OF THE INVENTION

Briefly stated, the universal golf club construction that forms the basis of the present invention comprises an adjustable length handle unit, a shaft unit, and a variable weight, pitch and lie club head unit. The adjustable handle unit is disposed on one end of the shaft unit and the club head unit is disposed on the other end of the shaft unit.

As will be explained in greater detail further on in the specification, the club head construction is particularly unique in that a dual toothed arrangement is employed which allows the user to vary the angular orientation of the club head about two independent and generally perpendicular horizontal axes, such that the pitch and the lie of the impact face of the club head may be selectively chosen by the user.

In addition, the club head construction is further designed to accommodate a plurality of both discrete and enlarged weight inserts to not only vary the overall weight of the club head, but to also selectively distribute the weight inserts about the club head.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
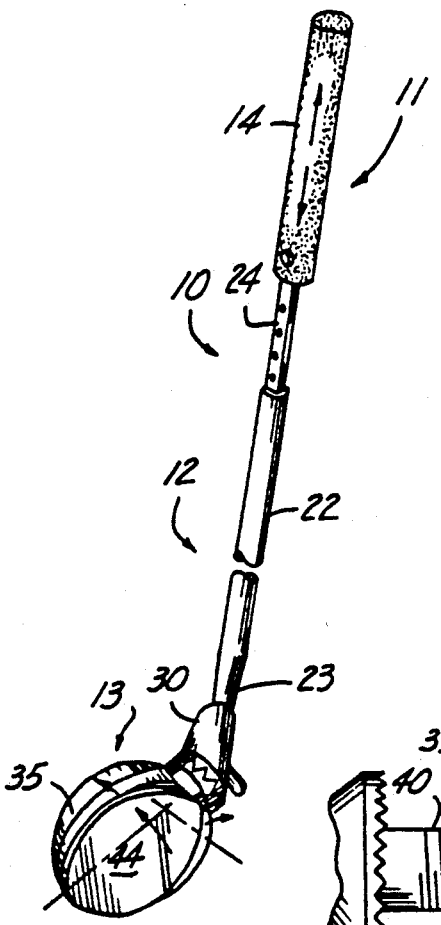
FIG. 1 is a perspective view of the universal golf club construction.

As can be seen by reference to the drawings, and in particular to FIG. 1, the universal golf club construction that forms the basis of the present invention is designated generally by the reference numeral (10). The construction (10) comprises in general, an adjustable length handle unit (11), a shaft unit (12), and a variable weight, pitch and lie club head unit (13). These units will now be described in seriatim fashion.

Figure 6:
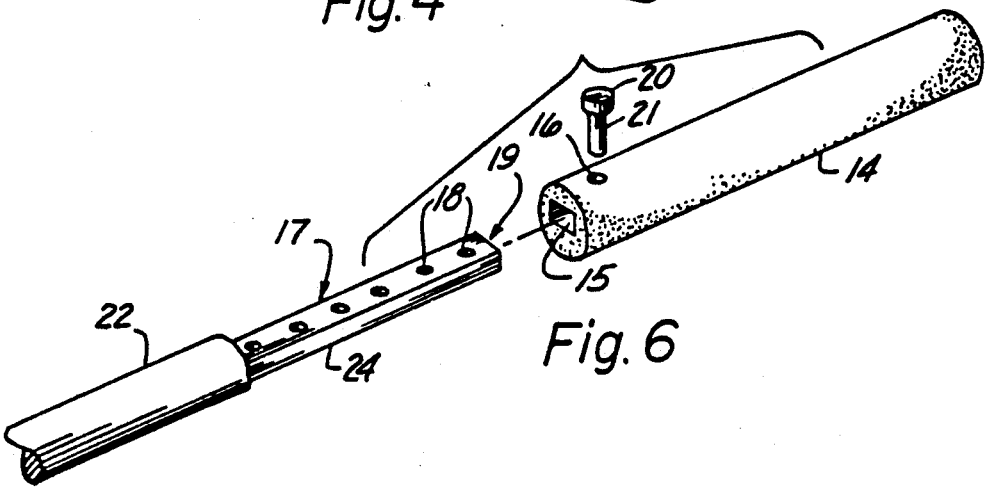
FIG. 6 is an exploded perspective view of the variable length handle arrangement.
Figure 7:
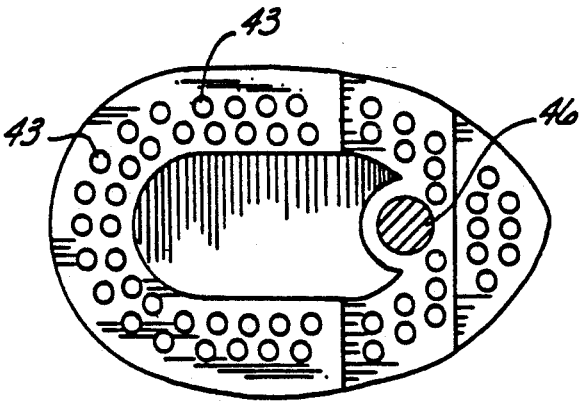
FIG. 7 is a detail view of the perimeter weight locations on the club head unit.

As can best be seen by reference to FIGS. 1 and 6, the adjustable handle unit (11) comprises an elongated outer handle grip member (14) having a elongated and enlarged generally rectangular recess (15) disposed along the longitudinal axis of the outer handle grip member (14) and a discrete peripheral aperture (16) which is in open communication with the recess (15).

In addition, the handle unit (11), further comprises an inner generally rectangular handle element (17) that is dimensioned to be slidably received in the generally rectangular recess (15) in the outer handle grip member (14). The inner handle element (17) is provided with a plurality of vertically aligned recesses (18), and a central generally rectangular recess (19) whose purpose and function will be described presently.

Furthermore, the handle unit (11) also comprises a locking pin member (20) having an elongated shaft (21) that is dimensioned to be received in the aperture (16) in the outer handle member (14) and a selected one of the vertically aligned recesses (18) in the inner handle element (17) to operatively engage the outer handle member (14) to the inner handle element (17) in a well recognized manner.

Figure 4:
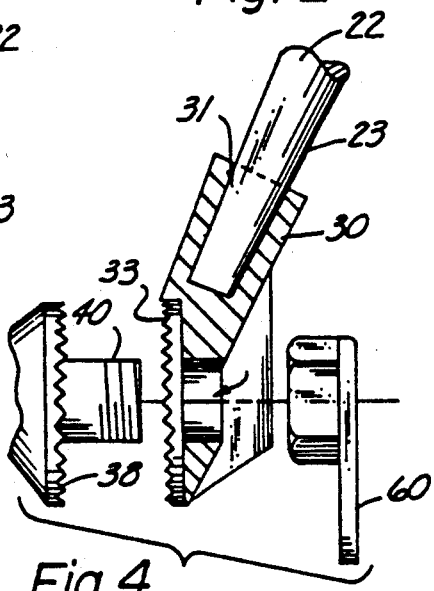
FIG. 4 is a side view of the auxiliary toothed element disposed on the golf club shaft.

As shown in FIGS. 1, 4, and 6, the shaft unit (12) comprises an elongated shaft member (22) which necks down to the lower end (23) and a generally rectangular upper end (24) wherein the upper end (24) of the shaft member (22) is dimensioned to be frictionally secured and received within the rectangular recess (15) in the handle member (14).

Figure 5:
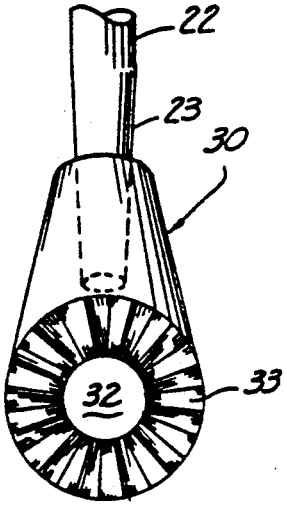
FIG. 5 is a front view of the arrangement depicted in FIG. 4.

Turning now to FIGS. 4 and 5, it can be seen that the tapered lower end (23) of the shaft member (22) is dimensioned to be secured to a club head mounting element (30) which includes a generally tapered recess (31) formed in the upper portion of the mounting element (30). The lower portion of the mounting element (30) is provided with a horizontally disposed transverse aperture (32) which extends through the mounting element (30). The inner periphery of the transverse aperture (32) is surrounded by a first auxiliary toothed element (33).

Figure 8:
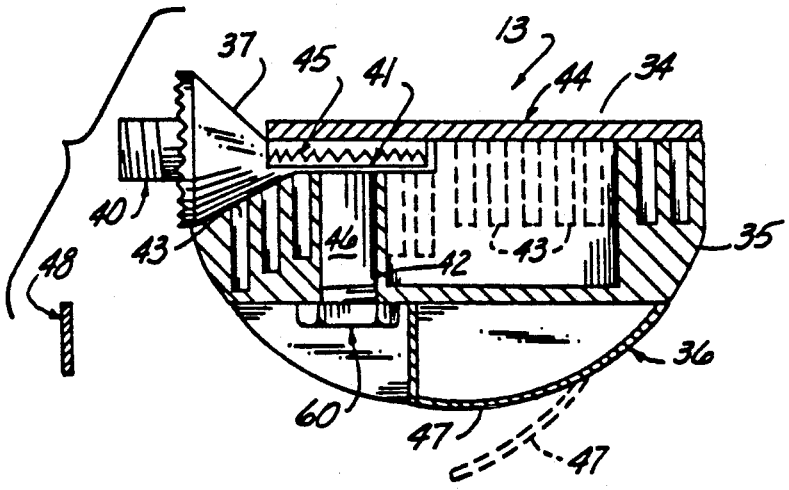
FIG. 8 is a cross sectional view taken through the movable portion of the club head unit.

As can best be seen by reference to FIG. 8, the club head unit (13) comprises in general, an impact face member (34), a main body member (35) and a rear body member (36) which are connected to the club head mounting element (30) by a main dual faced hosel member (37).

Figure 2:
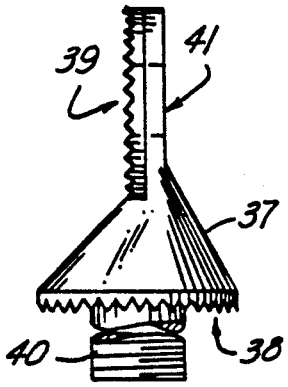
FIG. 2 is an isolated view of the dual toothed element.

Turning now to FIG. 2, it can be seen that the main toothed member (37) has two perpendicularly aligned hosel faces (38, 39). The inboard toothed face (38) is provided with an elongated first mounting post element (40) which is dimensioned to be received in and extend through the transverse aperture in the mounting element (30) and the outboard toothed face (39) is provided with an aperture (41) whose purpose and function will be described presently.

Returning once more to FIG. 8, it can be seen that the main body member (35) is not rigidly fastened to the outboard end of the main toothed member (37) and further provided with a transverse aperture (42) which is aligned with the aperture (41) in the outboard toothed face. In addition, the main body member (35) is further provided with a plurality of discrete elongated recesses (43) whose purpose and function will be described in greater detail further on in the specification.

Still referring to FIG. 8, it can be seen that the impact face member (34) comprises a face plate element (44) having a second auxiliary toothed element (45) formed on its rear surface. The second auxiliary toothed element (45) is further provided with a centrally disposed elongated second mounting post element (46) which is dimensioned to be received in and project through the apertures (41, 42) in the main toothed member (37) and the main body member (35), respectively.

Figure 3:
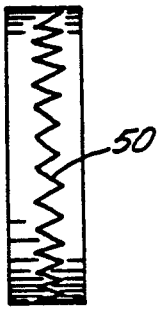
FIG. 3 is an isolated side view of the typical engagement between the main hosel element and one of the auxiliary toothed elements.

Turning now to FIGS. 3 and 5, it can be appreciated that a typical toothed interface comprises a pair of complimentary toothed gear faces (50) which when forcibly meshed together will prevent the rotary displacement of the gear faces (50) relative to one another in a well recognized manner.

Figure 9:
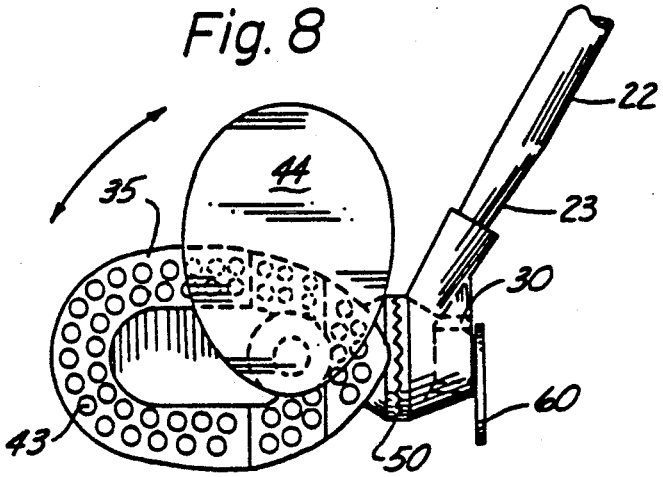
FIG. 9 is a rear view of the club head unit.

As can best be seen by reference to FIGS. 8 and 9, the rear body member (36) is outwardly and affixed to the rear of the main body member (35) so as to allow the second mounting post element (46) to project beyond the back of the main body member (35) and into the rear body member (36). In addition, the interior of the rear body member (36) is hollow and may be offset from main body member (35) and whose purpose and function will be described presently.

As mentioned previously, the main body member (35) is provided with a plurality of discrete elongated recesses (43). These recesses are intended to receive pin weights (48) in a selected number and distribution to vary the weight characteristics of the club head unit (13).

As can best be seen by reference to FIGS. 1 and 8, the first and second mounting post elements (40, 46) are further provided with locking cap members (60) which are intended to operatively, yet releasably secure the mounting post elements (40, 46) to the rear of the head mounting element (30) and the main body member (35) while providing a meshing engagement between the cooperating toothed gear faces (50).

At this juncture, it should further be noted that both the main (35) and rear (36) body members are vertically offset relative to the impact face member (34) for reasons that will be explained presently.

By now it should be appreciated that the golf club apparatus (10) that forms the basis of the present invention represents a significant advancement over the prior art. Not only is the effective length of the handle independently variable relative to the club head unit (13), but the club head unit is pivotable about two independent and perpendicularly aligned axis as represented by the mounting post elements (40, 46).

In the first instance, rotation of the club head unit about mounting post element (40) varies the pitch of the impact face member (34), and in the second instance, the rotation of the impact face member about mounting post element (46) varies the lie of the impact face member (34).

Furthermore, the selective weighting and positioning of the weight elements in the club head unit (13) is a feature never before incorporated into a variable angle golf club head construction.

Having thereby described the subject matter of the present invention, it should be apparent that many substitutions, modifications and variations of the present invention are possible in light of the above teachings. It is therefore to be understood that the invention as taught and described herein is only to be limited to the extent of the breadth and scope of the appended claims.

I claim:

1. A universal golf club construction comprising:
a shaft unit having an upper end and a lower end;
an adjustable length handle unit operatively associated with the upper end of the shaft unit;
a club head mounting element operatively attached to the lower end of the shaft unit; and
a club head unit rotatably connected to said club head mounting element about a first horizontal axis wherein the club head unit comprises:
a main body member; and, an impact face member rotatably connected to said main body member about a second horizontal axis which extends through said main body member and which is disposed generally perpendicular to said first horizontal axis.

2. The construction as in claim 1 wherein the club head mounting element is operatively connected to said main body member by a first mounting post element.

3. The construction as in claim 2 wherein the impact face member is operatively connected to said main body member by a second mounting post element.

4. The construction as in claim 2 wherein the club head unit further comprises:
a rear hollow body member affixed to the rear portion of said main body member.

5. The construction as in claim 3 further comprising:
a main toothed member affixed to said main body member and further provided with two perpendicularly aligned toothed faces wherein said toothed faces comprise an inboard toothed face axially aligned with said first horizontal axis and an outboard toothed face axially aligned with said second horizontal axis.

6. The construction as in claim 5 wherein said club head mounting element is provided with a transverse aperture dimensioned to receive said first mounting post element which projects outwardly from said inboard toothed face.

7. The construction as in claim 6 wherein said transverse aperture in said club head mounting element is surrounded by a first auxiliary toothed element which is dimensioned to engage said inboard toothed face.

8. The construction as in claim 7 wherein said main body member is provided with a transverse aperture dimensioned to receive said second mounting post element which projects rearwardly from said impact face member.

9. The construction as in claim 8 wherein said second mounting post element is surrounded by a second auxiliary toothed element which is dimensioned to engage said outboard toothed face.

* * * * *